US006220508B1

(12) United States Patent
Wisser

(10) Patent No.: US 6,220,508 B1
(45) Date of Patent: Apr. 24, 2001

(54) QUICK-LOCK OPEN-BOTTOM BULK BOX WITH EASY SET-UP FEATURE

(75) Inventor: David G. Wisser, Elk Grove Village, IL (US)

(73) Assignee: International Paper Company, NY (US)

( * ) Notice: Subject to any disclaimer, the term of this patent is extended or adjusted under 35 U.S.C. 154(b) by 0 days.

(21) Appl. No.: 09/653,578

(22) Filed: Aug. 31, 2000

(51) Int. Cl.[7] ..... B65D 5/06
(52) U.S. Cl. ..... 229/185; 229/109; 229/157
(58) Field of Search ..... 229/109, 156, 229/157, 185

(56) References Cited

U.S. PATENT DOCUMENTS 3,178,096 * 4/1965 Reeves et al. ..... 229/156
3,455,498 * 7/1969 Gadiel ..... 229/185
4,441,649 * 4/1984 Nederveld ..... 229/185
4,511,080 * 4/1985 Madsen et al. ..... 229/157
4,760,952 * 8/1988 Wachter et al. ..... 229/157
5,145,110 * 9/1992 Terpstra ..... 229/185
5,328,088 * 7/1994 Lonczak ..... 229/157
5,573,175 * 11/1996 Straub et al. ..... 229/109
6,076,730 * 6/2000 Boutin et al. ..... 229/157

* cited by examiner

*Primary Examiner*—Gary E. Elkins
(74) *Attorney, Agent, or Firm*—Dennis H. Lambert, Esq.

(57) ABSTRACT

A corrugated paperboard bulk box has opposed pairs of parallel side walls, and in a preferred embodiment, has interposed diagonal corner panels to form an octagonal box. The bottom of the box is open in the center and is formed by opposed pairs of interlocking major and minor bottom flaps, wherein one pair of opposed flaps have locking notches in their free edges and the other pair of opposed flaps have locking notches in their outer end edges. The locking notches in the respective pairs of flaps are adapted to interengage when the flaps are folded inwardly toward one another and pressure is exerted on one pair of the flaps, to lock the flaps in their folded relationship. An aligning notch is on a free edge of a pair of opposed bottom flaps for cooperative interengagement with an aligning slot at an adjacent end of the folding connection of an adjacent bottom panel for squaring the box as it is being set up. An aligning notch is also formed in an outer end corner of said pair of opposed bottom flaps, opposite the end having the aligning notch, for aiding in squaring the box.

20 Claims, 6 Drawing Sheets

FIG. 3
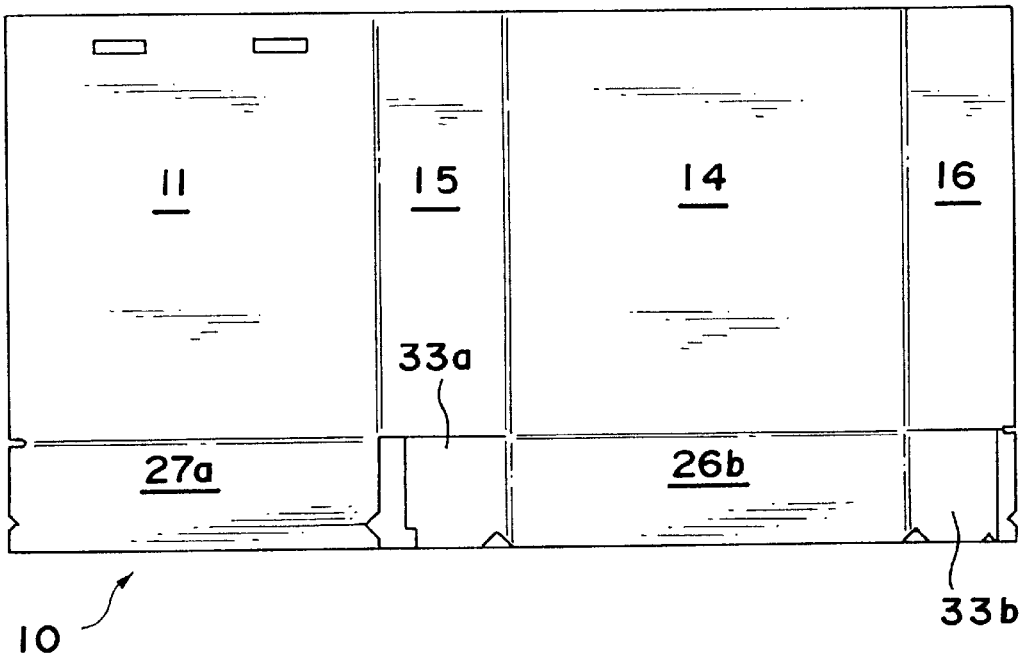
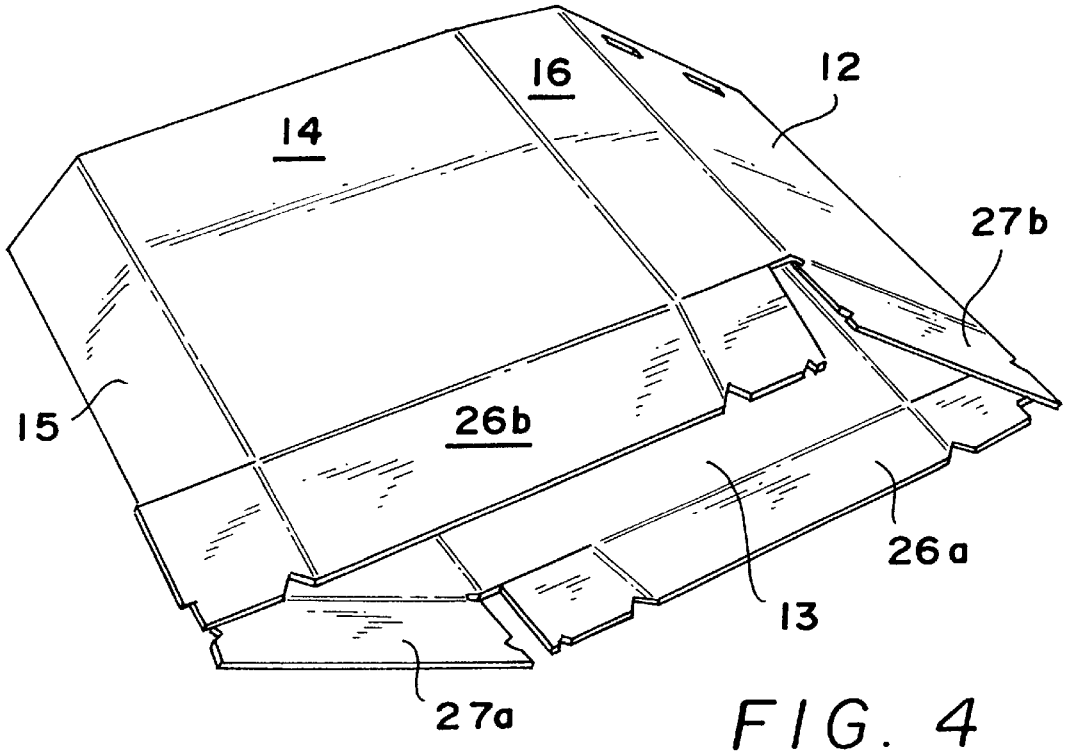
FIG. 4

QUICK-LOCK OPEN-BOTTOM BULK BOX WITH EASY SET-UP FEATURE

BACKGROUND OF THE INVENTION

1. Field of the Invention

This invention relates to containers for the bulk storage and shipment of materials. More particularly, the invention relates to a corrugated paperboard bulk box with set-up assisting features and a locking bottom flap construction.

2. Prior Art

In the bulk handling of materials, e.g., resins, dry food products, produce, etc., containers of relatively large size are commonly used to transport and store the material. These containers must be capable of withstanding the weight of the contents, as well as the rough handling to which they may be subjected. Further, they should be relatively easy to set up, and capable of being stacked on top of one another, and of being handled with mechanized equipment.

A variety of containers have been developed in the prior art to meet these criteria, including metal drums, plywood bins and corrugated paperboard boxes. While metal drums and plywood bins possess the requisite strength and durability, they are expensive to manufacture, store and ship. Corrugated paperboard boxes are less costly to make, and generally can be collapsed for compact storage and shipment. However, they may be difficult to set up, and/or may not be capable of withstanding rough handling.

Accordingly, there is a need for a bulk container which is inexpensive to make and use, is strong and durable, may be collapsed for compact storage and shipment, and which is easy to set up.

SUMMARY OF THE INVENTION

The present invention comprises a bulk container which is strong and durable, which may be collapsed for compact storage and shipment, and which may be set up quickly and easily.

The container of the invention preferably is made of corrugated paperboard having adequate strength to withstand the weight of the contents and to enable multiple containers to be stacked on top of one another. It is also capable of being palletized so that it can be efficiently handled with mechanized equipment. The container is shipped to a point of use in a compact flattened condition, and has a locking bottom flap construction that is quick and easy to set up and is durable even when subjected to rough handling. In particular, the container of the invention has aligning means which facilitate positioning and squaring up of the container during set up, and which holds it in that position after it is set up.

In a preferred embodiment, the container of the invention is an octagonal corrugated paperboard box having opposed pairs of parallel side walls and diagonal corner panels. In the embodiment disclosed herein, the box is of the open bottom style, having opposed pairs of bottom flange flaps that are foldably joined along score lines at one edge to respective pairs of opposed side walls, and that have opposite free edges that are spaced from one another after the box is set-up, defining a central opening through the bottom of the box.

In the preferred embodiment, the flaps comprise a pair of opposed minor flaps and a pair of opposed major flaps. The major flaps include side portions extending in alignment with and cut from the bottom ends of the associated diagonal corner panels, so that when the major flaps are folded inwardly over the bottom of the box, the corners of the side portions project beyond the diagonal corner panels to define fastening tabs that may be used to secure the box to a pallet.

The locking bottom flap construction includes a locking notch or cut-out in each of the opposite end edges of each of the minor flaps, and a pair of V-shaped locking notches in the free edge of each of the major flaps, located adjacent each of the opposite ends of the free edge. When the flaps are folded inwardly toward one another over the bottom of the box, the locking notches in the ends of the minor flaps engage in the locking notches in the free edges of the major flaps to lock the flaps in their inwardly folded position.

The aligning means includes an aligning slot at one end of the score line joining each minor bottom flap to its associated side wall, a small aligning notch in the free edge of each of the major bottom flaps, at one end thereof, and a notch in the outer free corner of each major bottom flap. The aligning slots and associated aligning notches are located such that a set of cooperatively interengaged slots and notches are in each of diagonally opposite corners of the box when the box is set up.

The box is preferably made from a single blank of corrugated material, folded upon itself and glued at a manufacturer's joint to form an open-ended, flattened tubular structure. The box may then be shipped in this flattened condition to a point of use, and stored until ready to use, at which time the flattened box is opened to its generally octagonal tubular shape, and if desired during set up is inverted to rest on its open top end, with the bottom end oriented uppermost.

During set up of the box, the major bottom flaps are first folded inwardly over the open bottom of the box, so that the notches in the free edges of the major bottom flaps engage in the slots at the end of the score line of a respective minor bottom flap to position and square-up the box and hold it in this position as the box is being set up and after the box is set up. In this regard, one set of an adjacent notch and slot may first be interengaged, and the set at the diagonally opposite side of the box then interengaged. These interengaged notches and slots substantially hold the box in its squared position without need of further aligning means, but to insure proper and complete squaring of the box, the minor bottom flaps are next folded inwardly, and the notch in the outer end corner of the major bottom flap is used as a guide to further insure that the box is square. The minor bottom flaps are pushed inwardly to cause the flaps to flex and enable the free end corners of the minor flaps to move past and behind the major flaps with a snap action. When inward pressure on the minor flaps is released, the memory of the flap material causes the flaps to rebound or move outwardly, firmly interlocking the notches in the free edges of the major flaps with the notches in the end edges of the minor flaps, respectively.

As can be seen from the foregoing, when the major flaps and then the minor flaps are folded inwardly over the bottom of the box into overlying relationship with one another, the aligning notches and slots cooperate with one another to align the box and hold it aligned during and after set-up. Further, it is necessary only to press inwardly on the minor flaps near the locking notches therein to cause the flaps to flex and for the outer free corner portions to move past the bottom flaps, whereupon following release of pressure on the minor flaps, they "spring" outwardly to engage behind the bottom flaps to lock the flaps in closed position. The bottom flaps are thereby securely interlocked with one another to form a strong flanged bottom that remains in its erected condition even when the box is roughly handled.

The erected box may then be set on a pallet, and a square or rectangular pad placed in the bottom. The pad is preferably sized so that it is freely movable in the box, but large enough to engage the flange flaps and close the bottom even if the pad is not centered in the box.

Means may also be provided in the sidewalls for locking cooperation with a closure cap to be fitted over the top end of the box. In one embodiment, this means comprises a plurality of openings formed through at least a pair of opposed side walls near the top end thereof.

Although the preferred embodiment is an octagonal or eight-sided box, it should be understood that the locking flap construction of the invention may be adapted to other polygonal shapes, such as a four-sided or ten-sided box, for example. Further, the box of the invention may comprise any suitable flute construction, including AA, CA, BC, etc., depending upon the desired properties. Moreover, a moisture resistant adhesive may be used in the manufacture of the box, which may additionally be treated with a suitable commercially available moisture resistant material. Further, if desired, a liner may be placed inside the box. The liner and the box may each comprise one-piece triple wall constructions laminated together.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein:

FIG. 3 is a top plan view of the box of the invention lying on its side in a folded flat condition;

FIG. 4 is a bottom perspective view of a box according to the invention, shown partially opened, with its bottom side nearest and the major flaps oriented uppermost and lowermost and the minor flaps oriented at opposite sides, respectively;

DETAILED DESCRIPTION OF THE PREFERRED EMBODIMENTS

Referring more specifically to the drawings, an octagonal corrugated bulk box according to the invention is indicated generally at 10. The box includes pairs of opposed parallel side walls 11, 12 and 13, 14, with interposed diagonal corner panels 1 5, 16, 17 and 18, joined along longitudinal scores or fold lines 19, 20, 21, 22, 23, 24 and 25. Although not shown, a lid or cover may be placed on the open upper end of the container, and the box may be mounted on a pallet (not shown).

The bottom of the box comprises opposed pairs of major bottom flange flaps 26*a*, 26*b* and minor bottom flange flaps 27*a*, 27*b*, respectively foldably joined along transverse fold lines 28*a*, 28*b* and 29*a*, 29*b* at one edge to the bottom edges of the opposed pairs of side walls.

The major and minor bottom flaps have opposite free edges 30*a*, 30*b* and 31*a*, 31*b*, respectively, that are spaced from one another to define a central opening O in the box bottom.

The major flaps include side portions 32*a*, 32*b* and 33*a*, 33*b*, respectively, extending in alignment with and cut from the bottom ends of the associated diagonal corner panels, so that when the major flaps are folded inwardly over the bottom of the box, the corners of the side portions project beyond the diagonal corner panels to define fastening tabs 34, 35, 36 and 37 that may be used to secure the box to a pallet. In this regard, the box may be placed upon a suitable pallet, and the tabs stapled or otherwise secured to the pallet.

As described hereinafter, the bottom flange flaps of the box include aligning means that functions to automatically square up the box as it is being erected or set up, and to hold the box square. In addition, the flaps include self-locking means that interengage to lock the flaps in their folded closed positions when the flaps are folded inwardly toward one another over the bottom.

Figure 1:
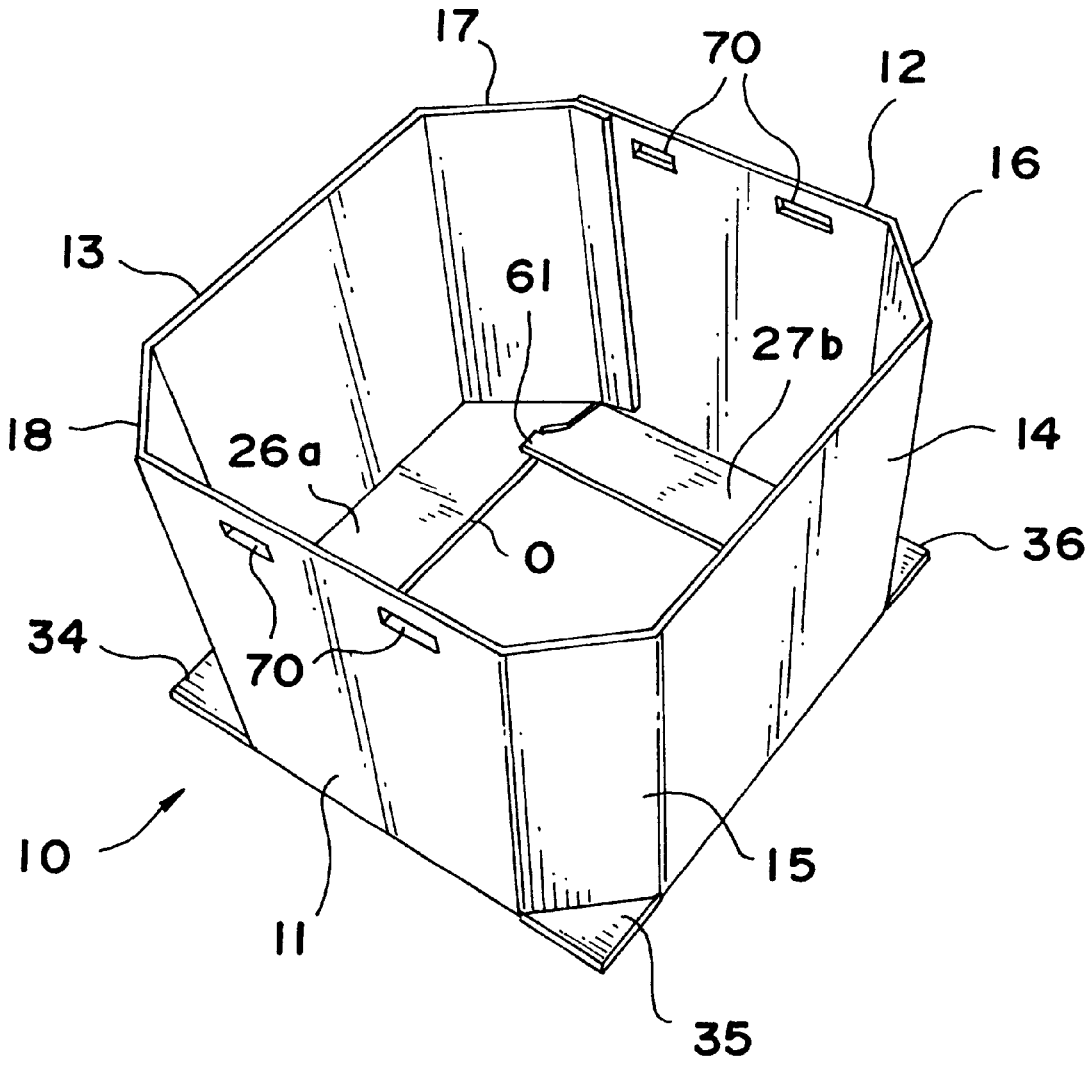
FIG. 1 is a top perspective view of an erected box according to the invention, shown without a cover or cap.
Figure 2:
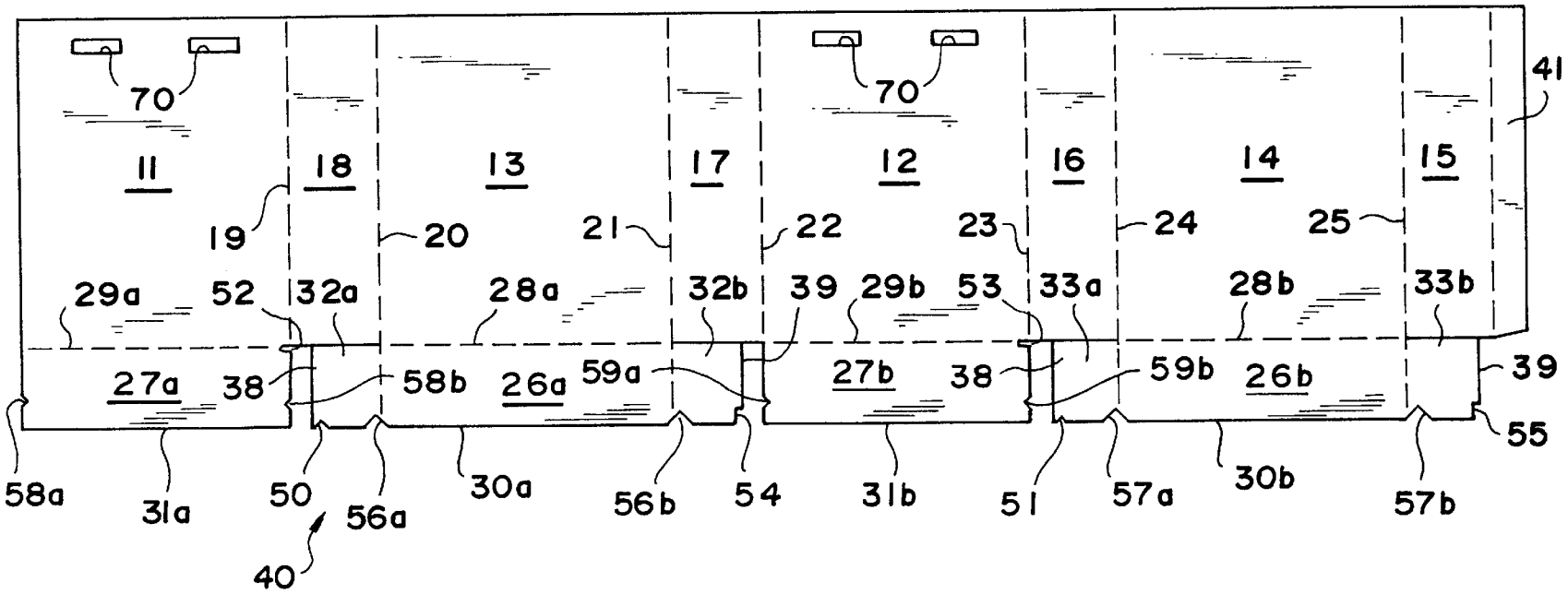
FIG. 2 is a top plan view of the blank used to make the box of the invention.

With particular reference to FIG. 2, the box of the invention is made from a single blank 40 of material, and includes a glue flap 41 on one side edge thereof. During manufacture, the blank is folded upon itself and the glue flap is adhesively attached to a side panel 11 at the opposite edge of the blank to form a flattened, open-ended tubular construction as shown in FIG. 3. The box may be stored and shipped in this flattened condition to a point of use.

The aligning means comprises alignment notches 50 and 51 in the free edges of the side portions 32*a*, 33*a*, respectively, closely adjacent the end edges 38, 39 of the respective side portions, and cooperating aligning slots 52 and 53 at an adjacent end of the score joining an adjacent minor bottom flap to its associated side panel. Additionally, notches 54 and 55 are cut in the outer corners of the side portions 32*b*, 33*b* for cooperation with an adjacent edge of an adjacent minor flap to assist in squaring the box as the minor flaps are folded inwardly toward one another.

The self-locking means comprises a pair of notches 56*a*, 56*b* and 57*a*, 57*b*, respectively, in the free edges of the major flaps, in alignment with the longitudinal score joining the associated side panel to an adjoining corner panel, and a pair of notches 58*a*, 58*b* and 59*a*, 59*b*, respectively, in the side edges of the minor flaps.

Figure 5:
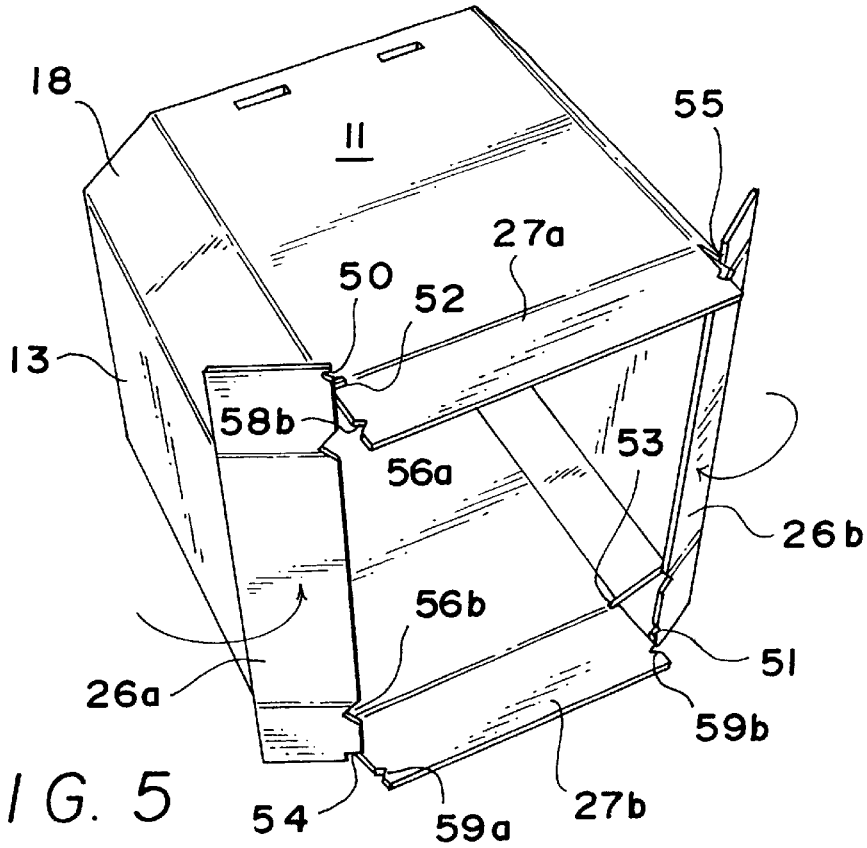
FIG. 5 is a bottom perspective view of the box, shown oriented with the minor flaps oriented uppermost and lowermost, and with the major flaps being folded inwardly to bring their respective aligning notches into registry with an associated aligning slot at the adjacent end of the score of an associated minor flap.

At the point of use, the flattened box is opened up or expanded into the tubular configuration shown in FIGS. 4 and 5. The box is easiest to set up while inverted and standing on its top end, but it may be set up while lying on its side, with the minor bottom flaps 27*a* and 27*b* oriented uppermost and lowermost, respectively, as depicted in FIGS. 4–11. The box is shown being set up while lying on its side merely to more clearly show the action of the flaps and their associated aligning means and self-locking means.

Figure 6:
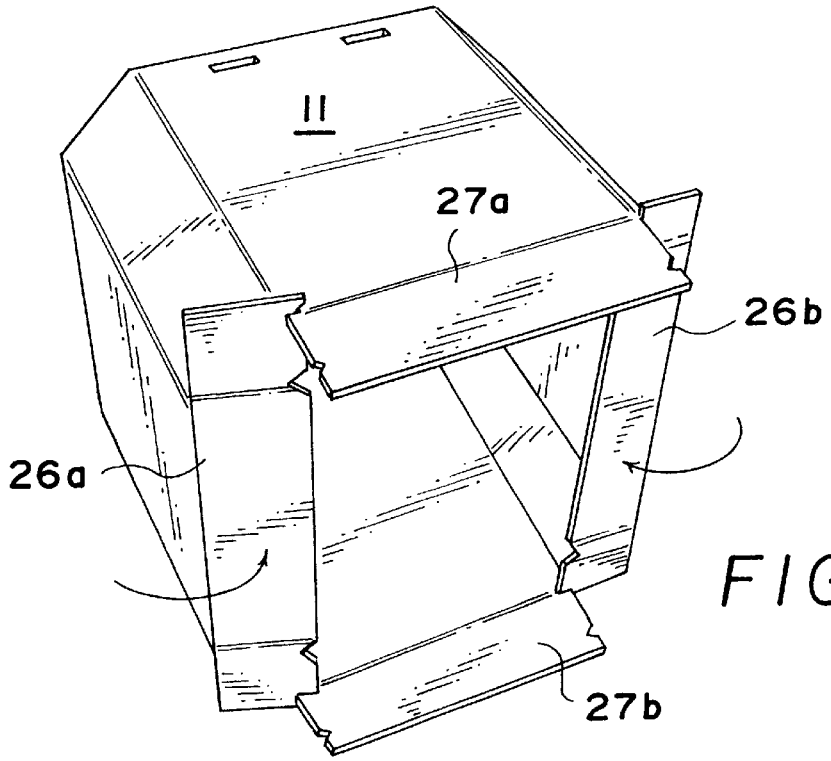
FIG. 6 is a bottom perspective view similar to FIG. 5, but showing both major flaps folded inwardly and their associated aligning notches interengaged with respective aligning slots to hold the box in the "squared" position shown.

The major bottom flaps 26*a* and 26*b* are then folded inwardly over the open end of the box, as shown in FIGS. 5 and 6, bringing the aligning notches 50 and 51 therein into registry with the aligning slots 52 and 53 at the respective scores for flaps 27*a* and 27*b*. At the same time, the opposite outer end edges of the major bottom flaps are aligned with the notches 54 and 55 cut in the outer corners of the major flap side portions 32*b* and 33*b*, respectively. It will be noted that the cooperating sets of aligning notches and aligning slots are located at diagonally opposite corners of the box. This arrangement achieves a stable and effective squaring of the box, that is secure even before the flaps are interlocked with one another.

Figure 7:
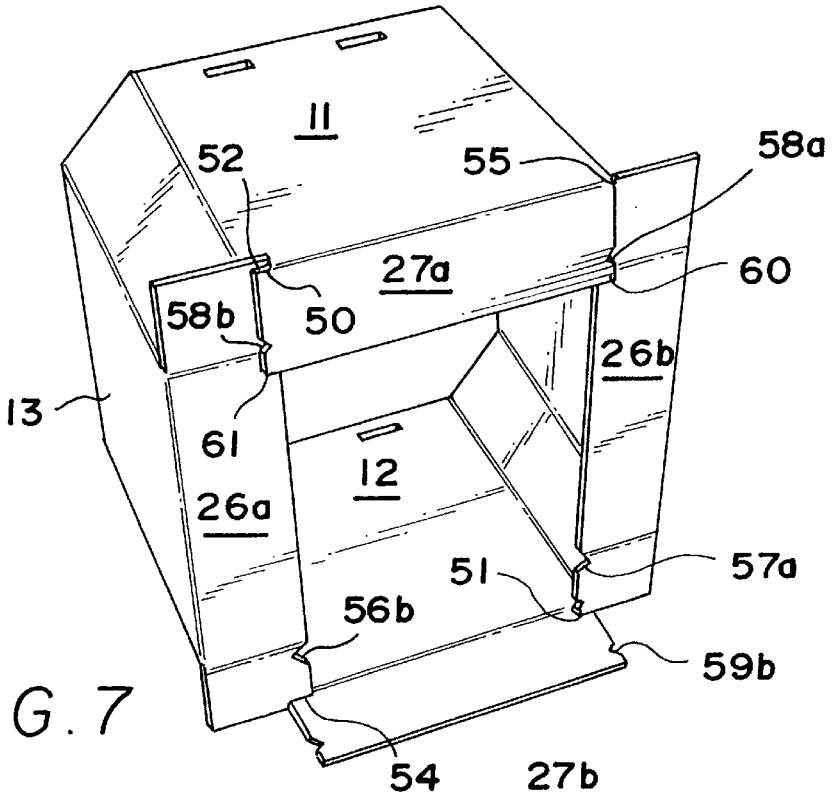
FIG. 7 is a bottom perspective view similar to FIG. 6, but showing one of the minor bottom flaps folded about its score line into overlying relationship with the major bottom flaps, and with the free outer corner portions in position to be pushed past the adjacent edges of the major flaps.
Figure 8:
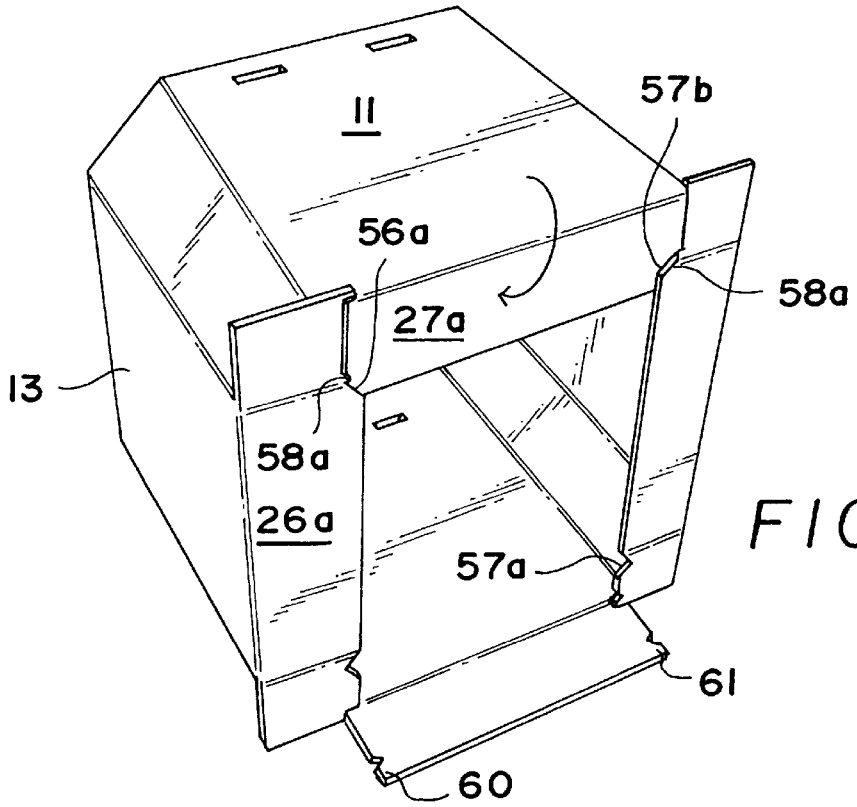
FIG. 8 is a bottom perspective view similar to FIG. 7, but showing the free outer edge corners engaged behind the edges of the major flaps, and the locking notches in the free edges of the respective minor and major flaps interengaged with one another to lock the flaps in this position.
Figure 9:
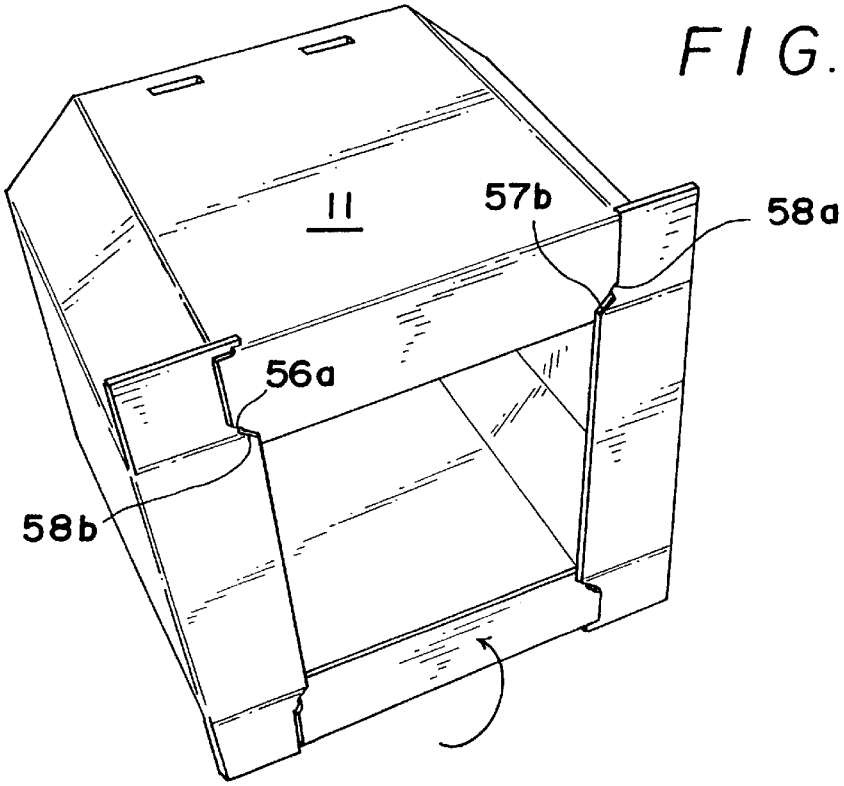
FIG. 9 is a bottom perspective view similar to FIG. 8, but showing both minor flaps in their inwardly folded locked position.
Figure 10:
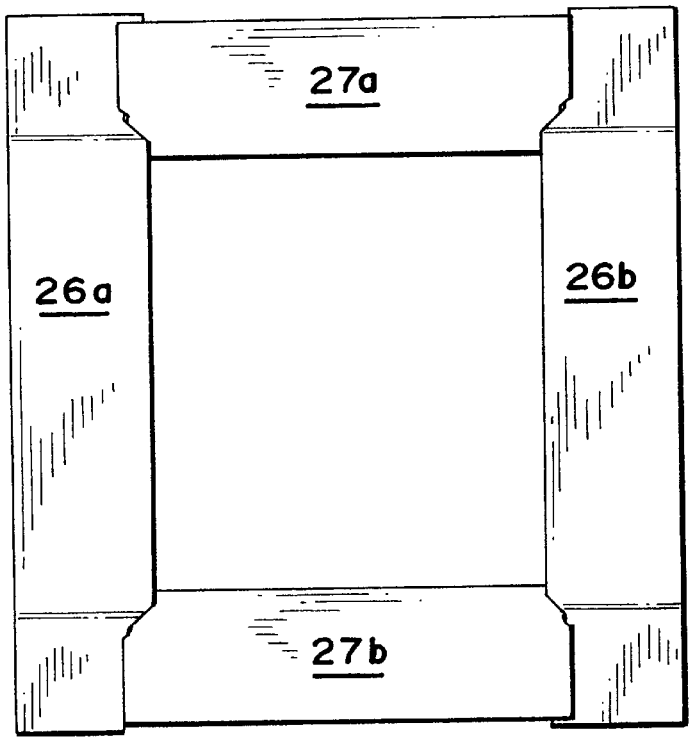
FIG. 10 is an outside bottom plan view of the box, with the flaps in their fully interlocked condition as shown in FIG. 9.

The minor flaps 27*a* and 27*b* are next folded inwardly over the major flaps, as depicted in FIGS. 7–9. As seen in these figures, the minor flap is first folded into overlying relationship with the major flap, and by then pushing inwardly against the minor flap near the locking notches therein, the corner portions 60, 61 thereof snap past and behind the adjacent edges of the major flaps. When pressure is released on the minor flap, its memory causes it to return outwardly, causing the locking notches 58*a*, 58*b* and 59*a*, 59*b* in the end edges of the minor flaps to interengage in the locking notches 56*a*, 56*b* and 57*a*, 57*b* in the free edges of the major flaps, securely locking the major and minor flaps in their inwardly folded positions.

The erected box may then be inverted and placed on a pallet for use. Further, although not shown, a square or rectangular pad may be placed in the bottom of the box, lying at its periphery on the bottom flaps of the box.

At least some bulk boxes in accordance with the invention may have a liner laminated on the inside wall. The liner, and the box, may both comprise triple wall AA flute, suitably treated for moisture resistance. Alternatively, other flute constructions, suitable for a particular application, may be used in the construction of the box.

Further, in the particular embodiment illustrated and described herein, openings 70 are formed in some of the sidewalls for cooperating with a locking structure on a cap (not shown) to be placed on the open upper end of the box.

While particular embodiments of the invention have been illustrated and described in detail herein, it should be understood that various changes and modifications may be made to the invention without departing from the spirit and intent of the invention as defined by the scope of the appended claims.

What is claimed is:

1. A folded-flat box made from a single blank of material, comprising:

a plurality of sidewall-forming panels;

a plurality of bottom-forming flaps foldably connected at one edge to respective sidewall-forming panels, and having an opposite free edge;

an aligning notch on the free edge of at least one bottom-forming flap;

an aligning slot at an adjacent end of the foldable connection of an adjacent bottom-forming flap, said aligning notch and aligning slot adapted to interengage to square said box as it is being set up; and a glue flap connected to one of said sidewall-forming panels at one end of the blank, said blank folded upon itself with said glue flap adhesively joined to a sidewall-forming panel at an opposite end of the blank, with some of said sidewall-forming panels and some of said bottom-forming flaps overlying other sidewall-forming panels and other bottom-forming flaps, respectively, to form a compact flattened box for shipment to a point of use, where the box may be quickly and easily set up.

2. A folded-flat box as claimed in claim 1, wherein:

said bottom-forming flaps are relatively narrow and the free edges thereof remain spaced from one another when the box is erected and the bottom-forming flaps are folded inwardly over the bottom of the box, leaving a central opening in the bottom of the box; and the free edges of an opposed pair of bottom-forming flaps have a pair of spaced locking notches therein, and outer end edges of an adjacent pair of opposed bottom-forming flaps have locking notches therein, said locking notches in the free edges of the first pair adapted to interengage with the locking notches in the end edges of the second pair when the bottom-forming flaps are folded inwardly over the end of the box into overlying relationship with one another and pressed, to lock the flaps in their folded relationship.

3. A box as claimed in claim 1, wherein:

said aligning means includes an aligning notch and complemental aligning slot on each of two opposite sides of said box when the box is erected.

4. A box as claimed in claim 1, wherein:

the sidewall-forming panels define first and second pairs of opposed side walls and diagonal corner panels extending between adjacent edges of the side walls in an erected box, defining an octagonally shaped enclosure in an erected box; and the bottom-forming flaps include a pair of opposed major flaps having side portions extending in alignment with and cut from the bottom ends of the associated diagonal corner panels, so that when the major flaps are folded about their respective scores inwardly over the bottom of the box, corners of the side portions project beyond the diagonal corner panels to define fastening tabs that may be used to secure the box to a pallet.

5. A box as claimed in claim 4, wherein:

the bottom-forming flaps include opposed minor bottom flaps;

the bottom flap aligning notches are on an outer free edge of the side portion at one end of the major bottom flaps; and the aligning slots are at adjacent ends of the scores joining the minor bottom flaps to their associated side panels.

6. A box as claimed in claim 5, wherein:

an aligning notch is on an outer end corner of at least one of said major bottom flaps side portions, on the end opposite said one end, for aiding in the squaring of said box as it is being set up.

7. A box as claimed in claim 1, wherein:

the sidewall-forming panels define first and second pairs of opposed side walls in an erected box, and the bottom-forming flaps define first and second pairs of opposed bottom flaps foldably joined to respective opposed side walls;

the free edges of a first pair of opposed bottom flaps have a pair of spaced apart notches therein; and outer end edges of a second pair of opposed bottom flaps each have a notch therein, said notches in the free edges of said first pair engaging with said notches in the outer end edges of said second pair to lock the flaps in their inwardly folded position over the box bottom.

8. A box having a top end and a bottom end, comprising:

a plurality of side walls defining an enclosure, said side walls having a top end and a bottom end;

a plurality of bottom flaps foldably joined along scores at one edge thereof to the bottom ends of respective side walls, said bottom flaps having free edges opposite their connection with the respective side walls and folded inwardly toward one another over the bottom of the box; and aligning means on at least some of said bottom flaps for cooperative interengagement to square the box as it is being set up, said aligning means comprising at least one bottom flap aligning notch in the free edge of at least one bottom flap, near one end thereof, and an opposed interengaged aligning slot at the adjacent end of the score line of an adjacent bottom flap.

9. A box as claimed in claim 8, wherein:

said aligning means includes an interengaged aligning notch and aligning slot on each of two opposite sides of said box.

10. A box as claimed in claim 8, wherein:

the side walls comprise first and second pairs of opposed side walls, and diagonal corner panels extend between adjacent edges of the side walls, defining an octagonally shaped enclosure; and the bottom flaps include a pair of opposed major flaps having side portions extending in alignment with and cut from the bottom ends of the associated diagonal corner panels, so that when the major flaps are folded about their respective scores inwardly over the bottom of the box, corners of the side portions project beyond the diagonal corner panels to define fastening tabs that may be used to secure the box to a pallet.

11. A box as claimed in claim 10, wherein:

the bottom flaps include opposed minor bottom flaps;

the bottom flap aligning notches are on outer free edges of the side portions of the major bottom flaps; and the aligning slots are at adjacent ends of the scores joining the minor bottom flaps to their associated side panels.

12. A box as claimed in claim 11, wherein:

the box is made of corrugated paperboard.

13. A box as claimed in claim 8, wherein:

the side walls comprise first and second pairs of opposed side walls, and the bottom flaps include first and second pairs of opposed bottom flaps foldably joined to respective opposed side walls;

the free edges of a first pair of opposed bottom flaps have a pair of spaced apart locking notches therein; and outer end edges of a second pair of opposed bottom flaps each have a locking notch therein, said locking notches in the free edges of said first pair engaging with said locking notches in the outer end edges of said second pair to lock the flaps in their inwardly folded position over the box bottom.

14. A box as claimed in claim 9, wherein:

the interengaged aligning notches and slots are on diagonally opposite sides of said box.

15. A box as claimed in claim 14, wherein:

an aligning notch is on an outer end corner of said at least some bottom flaps, on the end opposite said one end, for aiding in the squaring of said box as it is being set up.

16. A box as claimed in claim 15, wherein:

the side walls comprise first and second pairs of opposed side walls, and the bottom flaps include first and second pairs of opposed bottom flaps foldably joined to respective opposed side walls;

the free edges of a first pair of opposed bottom flaps have a pair of spaced apart locking notches therein; and outer end edges of a second pair of opposed bottom flaps each have a locking notch therein, said locking notches in the free edges of said first pair engaging with said locking notches in the outer end edges of said second pair to lock the flaps in their inwardly folded position over the box bottom.

17. A single, unitary blank for forming a bulk box comprising:

at least four sidewall panels;

a bottom flap foldably connected along a score at one edge to one end of each sidewall panel, each bottom flap having an opposite free edge;

an aligning notch in a free edge of at least one bottom flap; and an aligning slot at an adjacent end of the folding connection of an adjacent bottom flap.

18. A blank as claimed in claim 17, wherein:

there are four sidewall panels, and relatively narrower corner panels interposed between adjacent sidewall panels; and said bottom flaps include a pair of major bottom flaps joined to alternate sidewall panels, said major bottom flaps having opposite side portions cut from and extending beneath adjacent corner panels, and a pair of minor bottom flaps joined to the other sidewall panels and alternating with the major bottom flaps.

19. A blank as claimed in claim 18, wherein:

an aligning notch is formed in a free edge of each major bottom flap, near one end thereof; and an aligning slot is formed at one end of the score for each minor bottom flap.

20. A blank as claimed in claim 19, wherein:

a pair of spaced notches are in the free edge of each major bottom flap; and a notch is in each outer end edge of each minor bottom flap.

* * * * *